US005405060A

United States Patent [19]

von Schuckmann

[11] Patent Number: 5,405,060

[45] Date of Patent: Apr. 11, 1995

[54] LIQUID SPRAY DEVICE

[76] Inventor: Alfred von Schuckmann, Kervendonk 63, 4178 Kevelaer 2, Germany

[21] Appl. No.: 101,798

[22] Filed: Aug. 3, 1993

Related U.S. Application Data

[63] Continuation of Ser. No. 652,322, Feb. 8, 1991, abandoned.

[30] Foreign Application Priority Data

Feb. 15, 1990 [DE] Germany ..... 40 04 653.2

[51] Int. Cl.[6] ..... B65D 83/00; B65D 83/06

[52] U.S. Cl. ..... 222/325; 222/401

[58] Field of Search ..... 222/325–327, 222/262, 372, 373, 383, 385, 394, 399, 400.8, 401

[56] References Cited

U.S. PATENT DOCUMENTS

| | | | |
|---|---|---|---|
| 337,943 | 5/1886 | Fonerden et al. | 222/401 |
| 1,080,835 | 12/1913 | Kelley | 222/401 X |
| 1,967,743 | 7/1934 | Mhaille et al. | 222/400.8 |
| 2,060,512 | 11/1936 | Magill | 222/400.8 |
| 2,598,869 | 6/1952 | White | 222/401 X |
| 2,608,320 | 8/1952 | Harrison, Jr. | 222/401 X |
| 2,710,711 | 6/1955 | Hutton | 222/400.8 |
| 3,198,405 | 8/1965 | Pfeil | 222/400.8 |
| 3,207,387 | 9/1965 | Brickman | 222/400.8 |
| 3,777,945 | 12/1973 | Nozawa et al. | 222/394 |
| 3,955,720 | 5/1976 | Malone | 222/401 X |
| 3,995,779 | 12/1976 | Mizzi | 222/401 |
| 4,082,222 | 4/1978 | Boris | 222/373 X |
| 4,119,244 | 10/1978 | Funke | 222/401 X |
| 4,147,284 | 4/1979 | Mizzi | 222/401 |
| 4,165,025 | 8/1979 | Mascia et al. | 222/401 |
| 4,167,941 | 9/1979 | Capra et al. . | |
| 4,235,353 | 11/1980 | Capra et al. | 222/383 X |
| 4,272,228 | 6/1981 | Kutik et al. | 222/383 X |
| 4,341,330 | 7/1982 | Mascia et al. | 222/401 |
| 4,492,320 | 1/1985 | Tada | 222/401 X |
| 4,606,477 | 8/1986 | Spengler et al. | 222/400.8 X |
| 4,667,856 | 5/1987 | Nelson | 222/325 X |
| 4,941,599 | 7/1990 | Reinertz et al. | 222/401 |
| 4,972,975 | 11/1990 | Fuhrig | 222/401 X |

FOREIGN PATENT DOCUMENTS

| | | | |
|---|---|---|---|
| 7723 | of 1895 | United Kingdom | 222/401 |
| 179740 | 5/1922 | United Kingdom | 222/401 |

*Primary Examiner*—Andres Kashnikow
*Assistant Examiner*—Kenneth DeRosa
*Attorney, Agent, or Firm*—Martin A. Farber

[57] ABSTRACT

A liquid spray device having an air pump (P) which can be actuated by means of a handle (3) and the pressure air cushion of which expresses the liquid (5) upon actuation of a headpiece-side outlet valve (4) and atomizes it by mixing with the liquid jet. In order to achieve a structurally simple storage which can dispense with springs, there is formed a cartridge-receiving space (11) which can be subjected to air pressure between the removable headpiece (2) and an air-pump handle (3) arranged on the opposite end. In this way, a stable spray jet without afterdrip is obtained.

18 Claims, 6 Drawing Sheets

Sp
7
8
x
41
68
42
z
35
2
36
43
39
26
4
a
b
2'
30
28
40
29
25
18
27
1'
24
44
17
20
45
19
11
16
22
14
-21-
6
15
5
1
K
23
12
60
59
13
59
47
Sch
48
10
3
56
9
55
67
61
61'
I
P
49
46
57
66
62
65
50
50
51
51
II
64
x

FIG.8
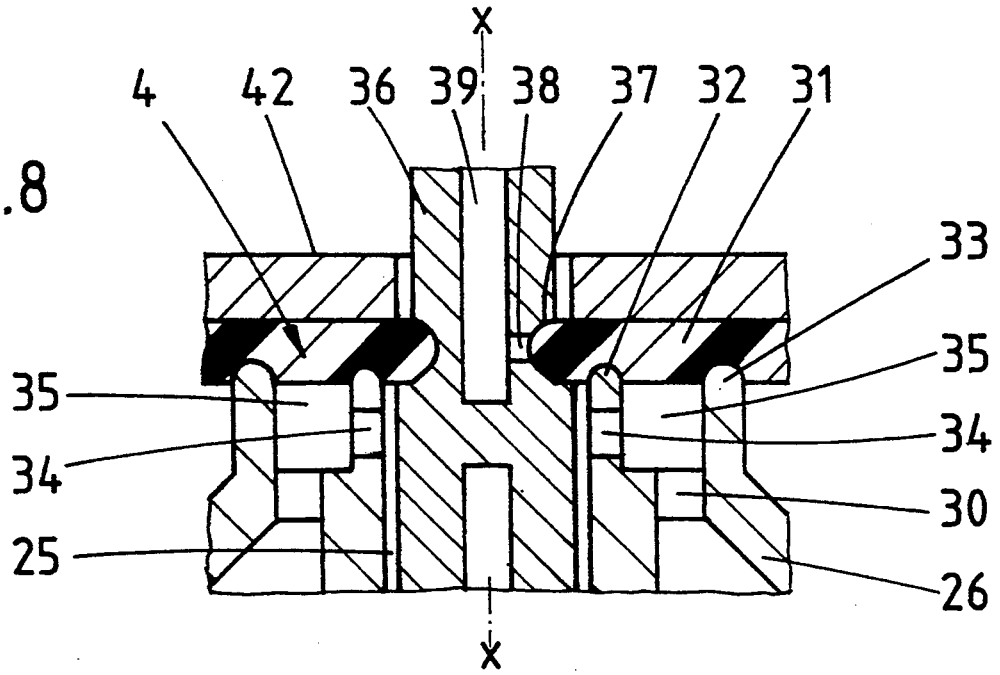
FIG.9
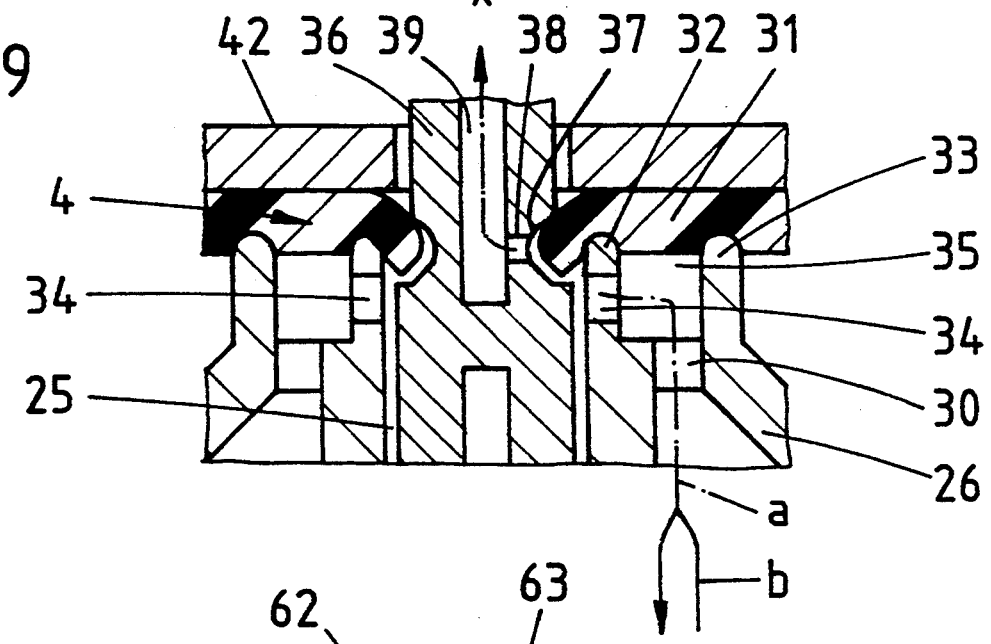
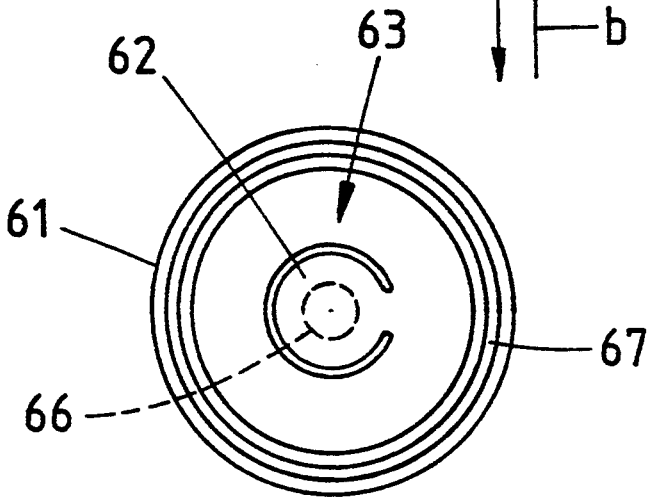
FIG.10

LIQUID SPRAY DEVICE

RELATED APPLICATION

This application is a continuation of my application Ser. No. 07/652,322 filed Feb. 8, 1991, now abandoned.

FIELD AND BACKGROUND OF THE INVENTION

The present invention relates to a liquid spray device having an air pump P which is adapted to be actuated by a handle (3) to provide an air pressure cushion which expresses a liquid (5) upon actuation of an outlet valve (4) on the headpiece-side, or front end of the spray device, and atomizes the liquid by mixing it with the liquid jet.

A liquid spray device of this type is known from U.S. Pat. No. 4,167,941. In that case, the air pump is actuated by a handle on the headpiece-side. The pressure cushion which builds up in this connection is present as storage force. The liquid is expressed by actuation of a headpiece-side dispensing valve. Due to the mixing of the liquid with the compressed air, atomization of the liquid jet takes place. In accordance with FIG. 17 the feeding takes place from two sources. The storage device consists in both cases of a chamber with a piston disk freely guided within it and which rests on a compression spring which is increasingly tensioned upon an increase in the filling of the corresponding chamber. The building up of the pressure cushion takes place via several small pistons upon a turning motion of the said handle. The pistons which are arranged radially transverse to the longitudinal central axis of the liquid spray device and in opposite directions engage for this purpose with their piston shaft via a control pin into a zigzag-shaped guide slot which, taking into account the turnability of the dispenser head, follows an undulated circular path. This requires a good deal of "turning work". There is furthermore a not inconsiderable tightness in movement due to the unfavorable alignment of the star-shaped sections of the guide slot which are provided in close sequence. The corresponding construction is, therefore, rather complicated.

The object of the present invention is so to develop a liquid spray device of this type in a manner which is simple to manufacture and advantageous in use that a strong, so-called "dry" spray jet is obtained without a storage which requires springs.

SUMMARY OF THE INVENTION

According to the invention, there is provided a cartridge-receiving space (11) which can be subjected to the air pressure between the removable headpiece (2) and an air-pump handle (3) arranged on the opposite, or back end of the spray device.

As a result of this development, there is obtained a liquid spray device of this type which is characterized by simple construction and dependable operation. Without special spring bodies and while retaining the customary proportion of volume for the dispensing mechanism proper there is obtained a stable profile of the spray jet so that even the very different fluids can be dispensed and even a cartridge system, which is environmentally more friendly, can be used to advantage. All of this is achieved by a cartridge-receiving space which can be brought under the air pressure and is arranged between the removable headpiece and air-pump handle arranged at the opposite end. The operating fluid can, therefore, be stored in gaps and spaces which are in any event present, this even with the inclusion of the space receiving the cartridge. In addition, there is the head region, i.e. the space made available by the headpiece. The unit which creates the corresponding pressure air cushion is in this connection seated in a manner favorable for actuation on the end facing away from the headpiece. The latter can, therefore, easily be removed for introduction of the next, full cartridge or for removal of the empty cartridge. It, furthermore, is advantageous that a plug-connection nipple which is arranged on the headpiece extends into the cartridge-receiving space, by which nipple the inside of the cartridge is connected to the air pressure. This results in a balanced distribution of the pressure air cushion, one part thereof effecting the lifting or feeding of the liquid and the other part effecting a surprisingly good atomization. In order to be able to maintain dependable operation of the corresponding function even if one intends to operate with the head pointing downward, it is furthermore proposed that the plug-connection nipple have a liquid barrier. The liquid itself is therefore prevented from unintentional emergence into the surrounding pressure cushion, while the air itself however passes via the plug-connection nipple into the inside of the cartridge. Such a liquid barrier is obtained concretely with simple means by the fact that the liquid barrier is formed by an annular diaphragm of the plug-connection nipple which rests with its lip edge on the outer wall of a riser pipe which conducts the liquid into the headpiece. The corresponding lip edge together with sufficiently flexible material of such a plug nipple acts extremely sensitively; separate developments of such a diaphragm are, therefore, not necessary. It is, furthermore, proposed that the air-pump handle be developed as rotary sleeve which is guided on the housing of the liquid spray device and is connected to an air-pump piston which travels in a cylinder chamber arranged within the housing. The outer shape of the housing is, therefore, advantageously used in this case as guide means for the rotary sleeve and the inner space for the associating and development of the cylinder chamber. This leads to a particularly simple structural solution. An advantageous development is furthermore obtained by a guide-slot control of the functional unit consisting of piston and air-pump handle. It is, furthermore, proposed that the cylinder chamber be formed by a constriction of the housing and that the means for the slot guidance be arranged in the remaining storage space. This retains for the liquid device of this type its customary slender shape, an additional advantage being furthermore obtained in this connection in that the shoulder formed by the constriction can be utilized as cartridge-placement bottom, the flow path being kept open as the result of passage openings left at this shoulder. With respect to the slot guidance, it specifically is formed by ascending grooves on the inside of the air-pump handle, a stationary radial guide pin of the housing engaging into each groove as so-called slide block. Such pins can be formed directly upon the injection molding. In order to obtain a slot guidance which is particularly easy operating, the guide pins are equipped with rollers. It is furthermore proposed that there be associated with the grooves essentially axial introduction shafts which are blocked in installed condition by a steeply dropping back ridge of the one guide-slot part. This leads to a dependable association of the means supplying the superimposing axial/rotary stroke of the piston. Furthermore, an advantageous development is obtained by a flatter course of the ascending grooves in the final phase of the pump movement, the grooves furthermore forming supporting pockets for the guide pins in both ends. There is obtained, on the one hand, easier actuation since just at the moment of increased resistance there is present the more flatly ascending zone. The supporting pockets define the end positions so that an angle of ascent which is far outside self-locking can be used for the grooves. The final limitation of the grooves is at a working stroke of about 135°. This results in easy operation since the actuating hand is not unduly stressed and ergonomic conditions are therefore taken into account. One favorable measure resides in the fact that the cylinder chamber has a transverse wall which supports the pump valve on the cartridge side and separates the constriction from the cartridge-receiving space of the housing, forming a pressure pre-chamber. This centrally located pressure pre-chamber leads to a uniform distribution of the pressure air cushion in a zone directly behind the source of pressure, i.e. the pressure pump. The invention furthermore proposes having the air-pump piston bear a piston packing with an annular space at its front end. Such annular space is suitably arranged in the edge region of the packing and, therefore, leads at the one end to the highly elastic or flexible packing-typical piston lip and at the other end to a stable transition to the remaining central region of the packing which is developed as a cup or dish. The piston packing assumes an additional function to the extent that it forms, at the same time, the valve flap of an inlet valve of the cylinder chamber and is clipped on snugly onto the cup-shaped end of a cap which is connected by screwing to the air pump-handle, the end being constricted on the housing side. In this way, the piston continues as inner leg of a U-section of the handle, which section is of rotational symmetry and grips around the lower end of the housing. It is furthermore proposed that the plug-connection nipple be centrally formed on a perforated holding plate which is edge-mounted between the upper end of the housing and the headpiece screwed thereto and which continues into an opposite nipple which is plug-connected to the headpiece. This results, not only in high total stability of the holding plate but also in satisfactory stability upon use for the two nipples which extend in opposite direction to each other, which is of importance also in view of the plug connection of the headpiece. It furthermore proves useful in this connection for the opposite nipple also being used in the head region to form a Y-channel of rotational symmetry, the Y-web of which leads to the outlet valve and the outer Y-arm of which is connected via a transverse channel to a headpiece chamber which extends above the cartridge-receiving space. With the cartridge inserted, there remains, due to the centering action of the plug-connection nipple, a uniform annular space between the outer wall of the cartridge and the inner wall of the housing. Another advantageous feature, finally, resides in the fact that the outlet valve can be actuated by a spray head push button which is urged by spring in the direction towards the basic closed position. Finally, another favorable development resides in an end-side annular space in the piston packing as pump limiter. When the pressure in the cartridge-receiving space is identical to the pressure in the end-side annular space of the piston, with the latter in its inserted end position, then additional pumping up of the cartridge-receiving space, etc. is no longer possible. As a result, the reliability in use of the liquid spray device described is also optimal.

BRIEF DESCRIPTION OF THE DRAWINGS

The object of the present invention will be explained further below with reference to an embodiment shown in the drawing, in which:

FIG. 8 is an enlarged view of the outlet valve in the closing position;

FIG. 9 is an enlarged view thereof in the open position as a result of actuation of the spray head push button and;

FIG. 10 is a top view of the pump piston.

DETAILED DESCRIPTION OF THE PREFERRED EMBODIMENTS

Figure 1:
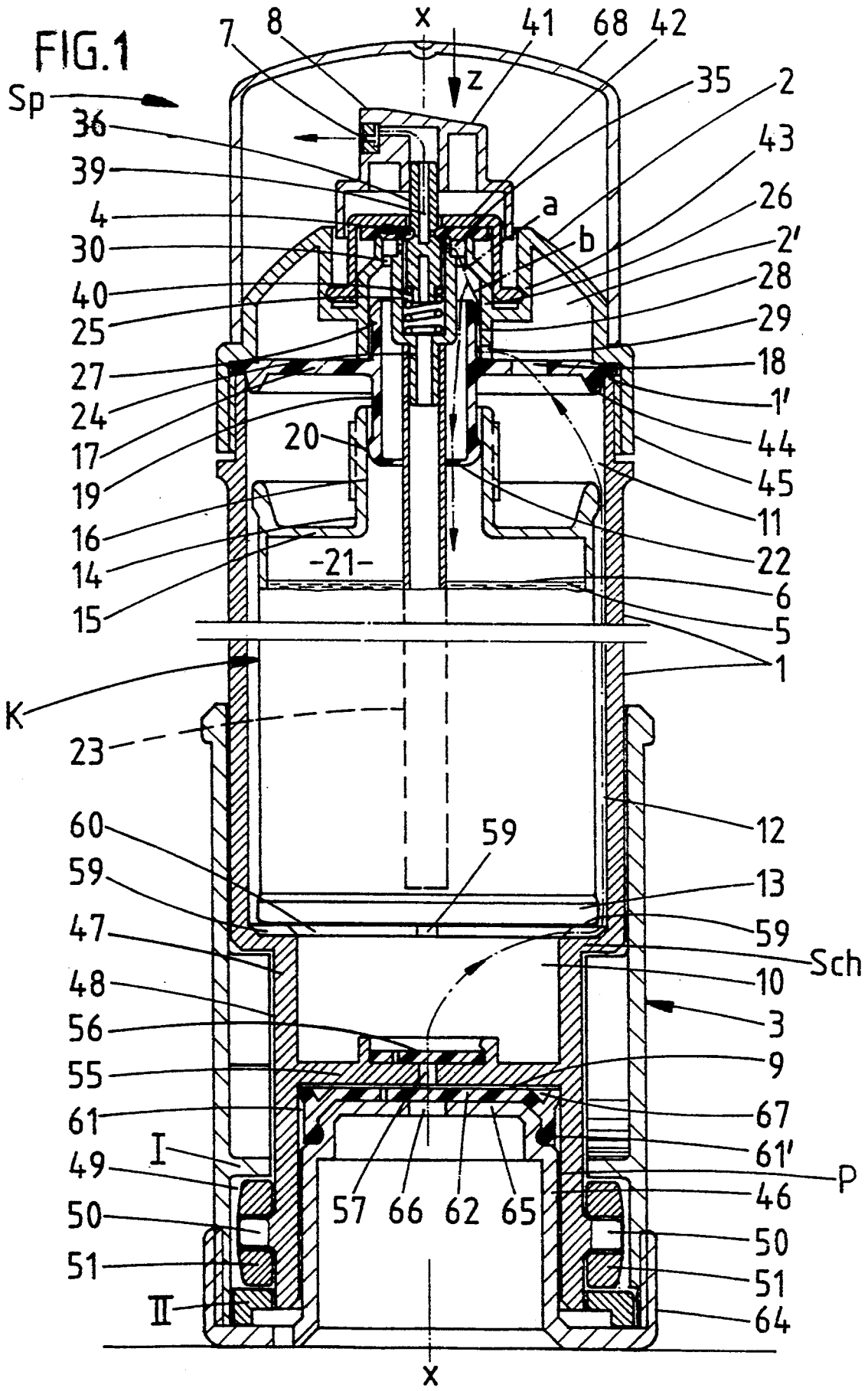
FIG. 1 is a vertical section through the liquid spray device of the invention developed as so-called dispenser, with the pump piston in the inserted end position.
Figure 2:
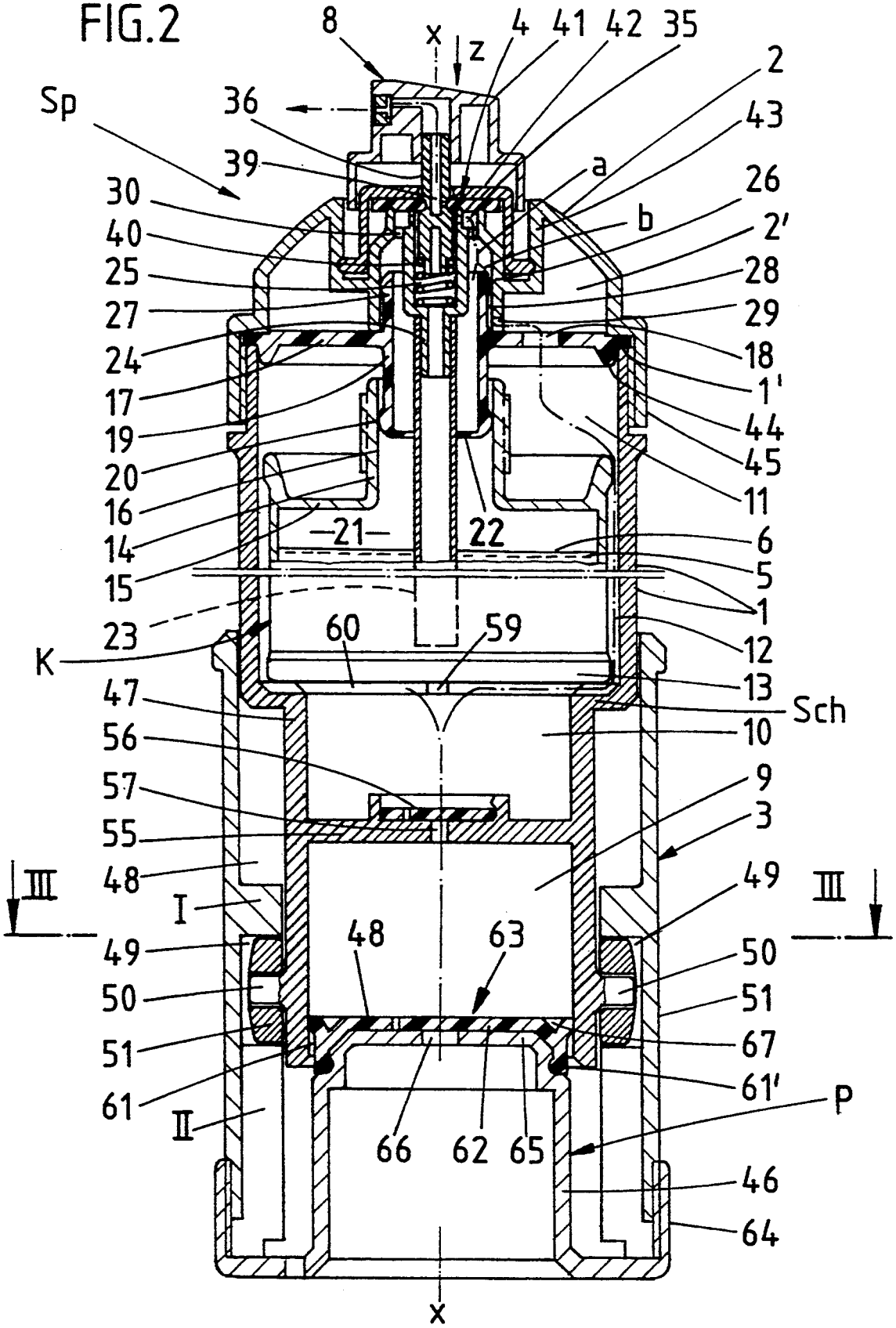
FIG. 2 is a view corresponding to FIG. 1 but with the pump piston extended into the opposite end position.
Figure 4:
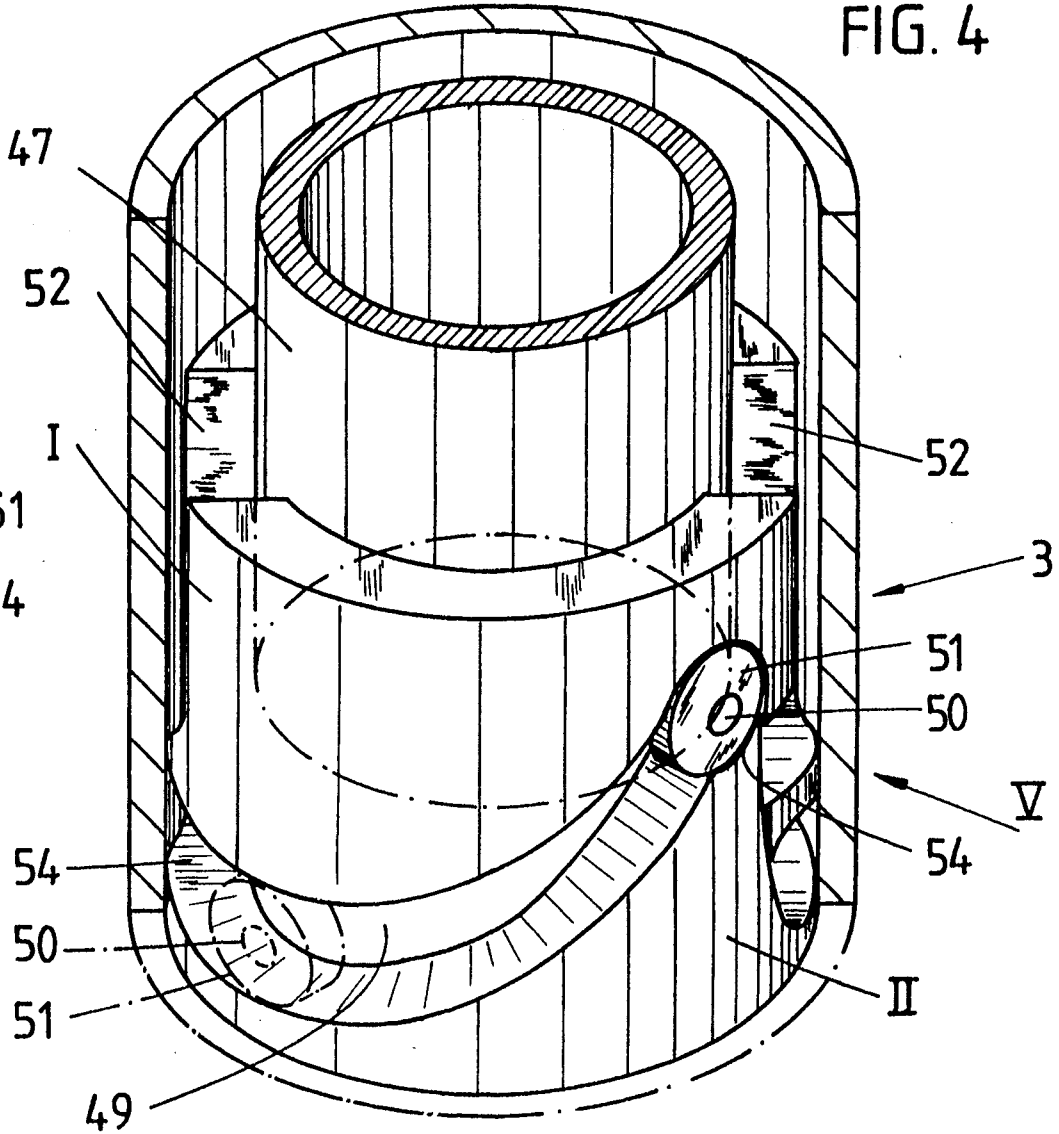
FIG. 4 shows, in perspective, the bottom-side section of the liquid spray device, illustrating the guide-slot control means.
Figure 3:
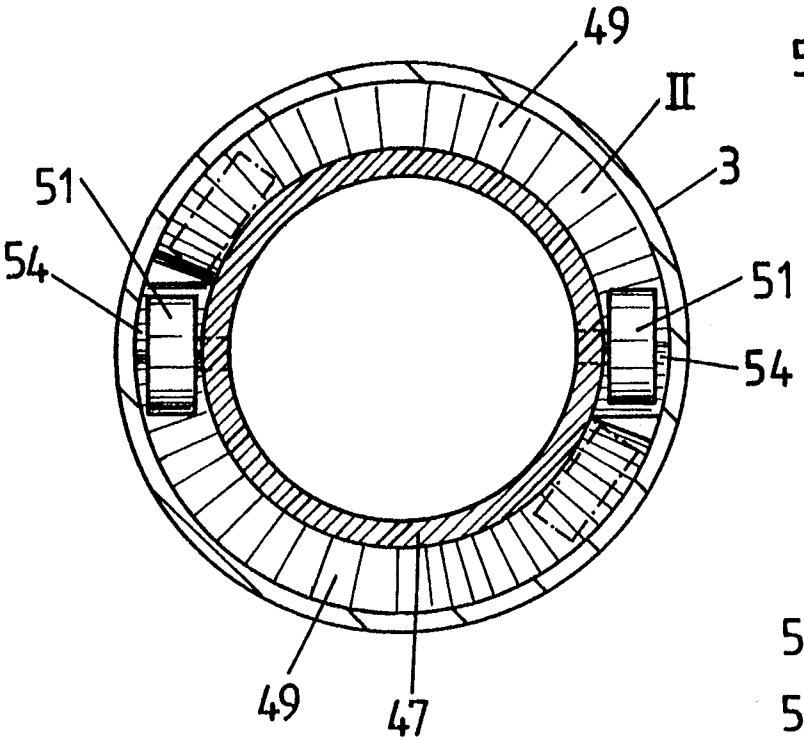
FIG. 3 is a section along the line III—III of FIG. 2.
Figure 5:
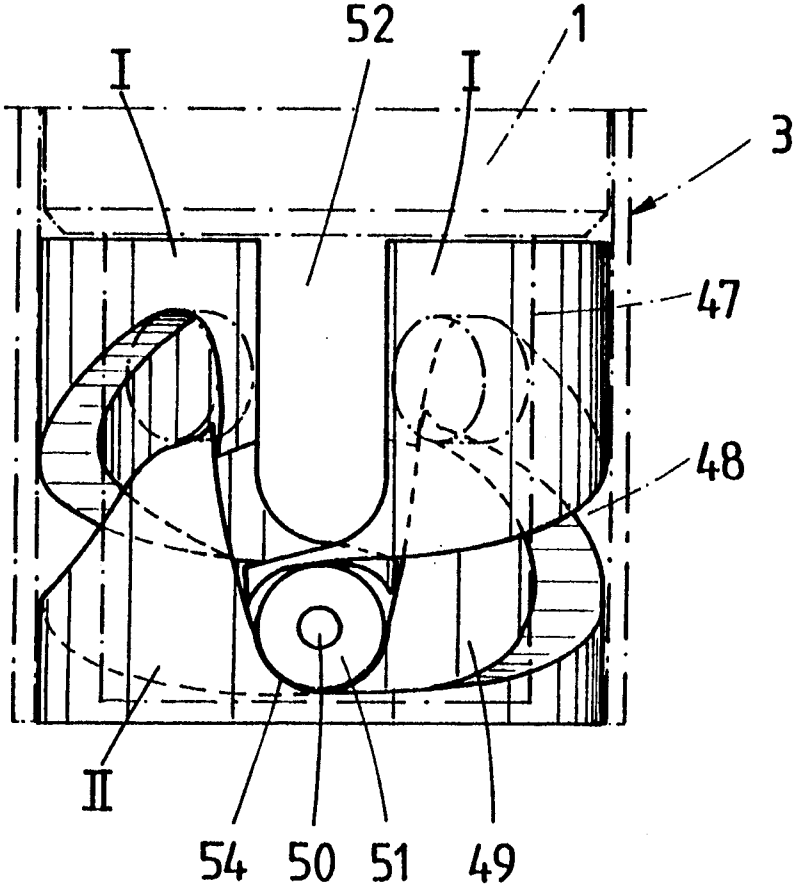
FIG. 5 is a view in the direction of the arrow V of FIG. 4, but with the piston retracted.
Figure 6:
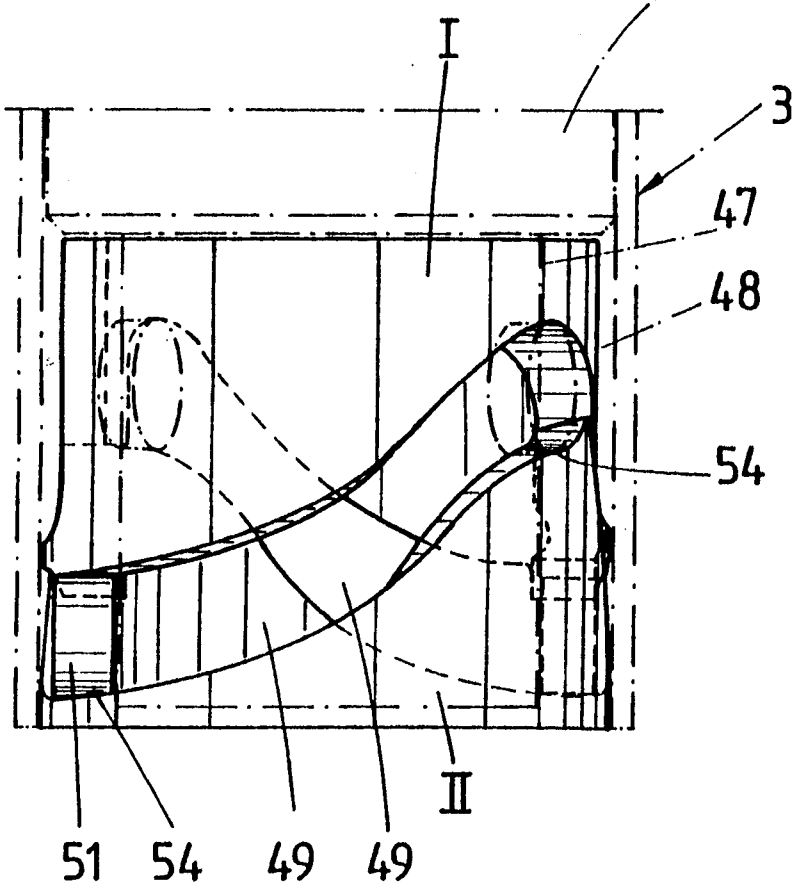
FIG. 6 is a view thereof shifted towards the left by about 90°.

The dispenser Sp which contains the liquid spray device of the invention is designed as an elongated, substantially cylindrical standing device which consists of a housing 1, a removable headpiece 2 and a handle 3. The latter serves to actuate an air pump P. The air-pump handle 3 is seated at the end of the housing 1 opposite the headpiece 2.

By a backward and forward twisting movement of the handle 3, the air pump P produces a pressure cushion inside the dispenser. By actuation of an outlet valve 4 on the headpiece-side, the pressure cushion causes the emergence of a liquid 5 contained in the dispenser in the manner that this pressure cushion both acts on the level 6 of the liquid 5 and atomizes it by mixing with the liquid jet. The liquid jet emerges from a so-called nozzle 7 of a corresponding spray device 8. The added air component leads to a so-called "dry" spray jet of stable shape.

The pressure cushion which builds up in the dispenser Sp is produced in a cylinder chamber 9 of the air pump P. The compressed air passes from there into a pressure pre-chamber 10. From there it is distributed into the portion of the housing 1 which serves to receive a cartridge K containing the liquid 5. The cartridge is attached to the dispenser Sp in replaceable manner. It has such a diameter that the cartridge-receiving space 11 leaves on the outer wall-side a resilient annular gap 12 so that there is a compressed-air connection into the headpiece 2, i.e. towards the spray device 8.

The cartridge K has the shape of a bottle and, therefore, passes into a neck 14 at its end opposite the edge-reinforced bottom 13. The neck 14 extends from the axially somewhat constricted cover 15 of the cartridge K and has a cylindrical mouth 16.

The free space of the housing 1 which remains around the neck 14 and also axially above same is closed off by a holding plate 17. The latter is perforated. The perforations consist of openings 18 one of which can be noted in FIG. 1. Via said perforations 18 the compressed air is connected to the dome-shaped inner space of the headpiece 2, or more accurately of the headpiece chamber 2'. From there the branching off or distribution takes place in the manner described above.

The cartridge-side connection for this is formed by a plug-connection nipple 19 which extends from said holding plate 17 and is connected indirectly to the headpiece 2. The nipple 19 enters in overlapping manner into the cylindrical mouth 16 of the neck 14. There is thus present a kind of pipe coupling. The lower outer edge of the plug-connection nipple 19 has a sealing bead 20. Via the plug-connection nipple 19 the inside 21 of the cartridge K is thus connected to the air pressure.

On the other hand, however, the liquid 5 is prevented from emerging via the mouth 16 of the neck 14 into the cartridge-receiving space 11, for instance in cases in which the dispenser Sp is used for spraying in upside-down position. This is achieved in the manner that the plug-connection nipple 19 has a liquid barrier which permits only the passage of air. There is concerned here a relatively thin-walled annular diaphragm 22. It rests with its possibly pointed lip edge, in sealing manner and yielding only to air pressure, against the outer wall of a riser pipe 23 which conducts the liquid 5 into the headpiece 2.

The riser pipe 23 extends from the removable headpiece 2. It extends in the longitudinal center axis x—x of the dispenser Sp up to the bottom 13 of the cartridge K, leaving a certain distance from it 13 so that the liquid can enter unimpeded into the lower end of the riser pipe 23.

The other, upper end of the riser pipe 23 sits on a central, downward directed connecting piece 24 which extends into the mouth 14 and is coaxial to a spring chamber 25 arranged above it. The wall of said spring chamber, which forms a cup open towards the top, continues via a cup edge into a sleeve part 26 which is open in the opposite direction and which, extending concentric to and spaced from the spring chamber 25, receives an opposite nipple extending from the top side of the holding plate 17. The latter nipple leaves between its outer wall and the inner wall of the sleeve part 26 an annular channel 28 which is connected to the pressure air cushion via one or more perforations 29. Furthermore, the edge which serves as transverse connection between the wall of the spring chamber 25 and-the sleeve part 26, has perforations 30. As a result, there is a free path to the closing outlet valve 4 (see FIG. 9).

The outlet valve 4, which consists of a horizontally inserted annular disk 31 of flexible material, rests on annular walls 32 and 33 which are arranged concentric to the longitudinal center axis x—x. The inner annular wall 33, which forms part of the spring chamber 25, has transverse channels 34. The latter establish the connection between the spring chamber and a circumferential cavity 35 below the annular disk 31.

A central shaft 36 constitutes another part of the outlet valve 4. At the level of the annular disk 31 said central shaft has an annular groove 37. On the bottom of the annular groove there is at least one branch channel 38. The latter connects the annular space portion of the spring chamber 25 which is passed through by liquid and air to a central outlet channel 39 which is connected directly to the nozzle 7 which branches off transversely.

The lower end of said shaft 36 extends into the spring chamber 25 and supports there the upper end turn of the compression spring 40 which urges the outlet valve into its closed position. The other end turn of said compression spring rests against an annular shoulder between the connecting piece 24 and the wall surrounding the annular chamber 25.

The outlet valve 4 is actuated via a free-standing spray head push button 41 of the headpiece 2 which push button is urged by spring into the closed position.

The upper limiting stop for the annular disk 31 is formed by a hat-shaped plug part 42 which is held fast in an annular groove of a cylindrical constriction 43 of the headpiece 2 and guides the shaft 36 above the annular disk 31.

The holding plate 17 which provides the plug connection with the cartridge K via the plug-connection nipple 19 is peripherally edge-mounted between the upper end edge 1' of the housing 1 and the headpiece 2 which is connected thereto by threading. The edge-mounted section of the holding plate has in front of it a centering projection 44 which imparts high internal stability to the edge region and to the entire structure part in general despite the elasticity of the material used, since the latter must after all also form the diaphragm 22.

In order to make the threaded-connection possible, a bell-shaped edge 45 with corresponding internal thread is formed on the headpiece 2, which is developed with rotational symmetry, said internal thread engaging into the corresponding external thread of the housing 1.

The channel situation described in the dispenser head leads to the opposite nipple 27 in the headpiece 2 being also used for the formation of a Y-channel of rotational symmetry, the Y-web 'a' of said wide channel pointing towards the outlet valve 4, while the outer Y-arm 'b° connecting, via the perforation 30, to the headpiece-chamber 2' which extends above the cartridge-receiving space 11.

With regard to the details concerning the development of the pump P, the air-pump handle 3 is developed as turnable sleeve which is guided on the housing 1 of the liquid spray device and is connected to an air-pump piston 46. In order to create its cylinder chamber 9, the lower section of the housing 1 continues into a constriction 47, which can be clearly noted from the drawing. The offset space 48 remaining due to the constriction 47 receives the means of a guide-slot control which displaces the piston 46. By offset space 48, there is meant the space which extends between the cylindrical outer wall of the constriction 47 and the also cylindrical inner wall of the handle 3 guided on the housing 1. The slender shape of the dispenser is thus retained. The guide-slot control is formed by two helically ascending, radially inward directed open grooves 49. They are seated on the inside of the air-pump handle 3. They are connected in non-overlapping manner and each cooperates with a stationary, radially outward directed guide pin 50 of the housing 1 or its constriction 47 respectively.

Figure 7:
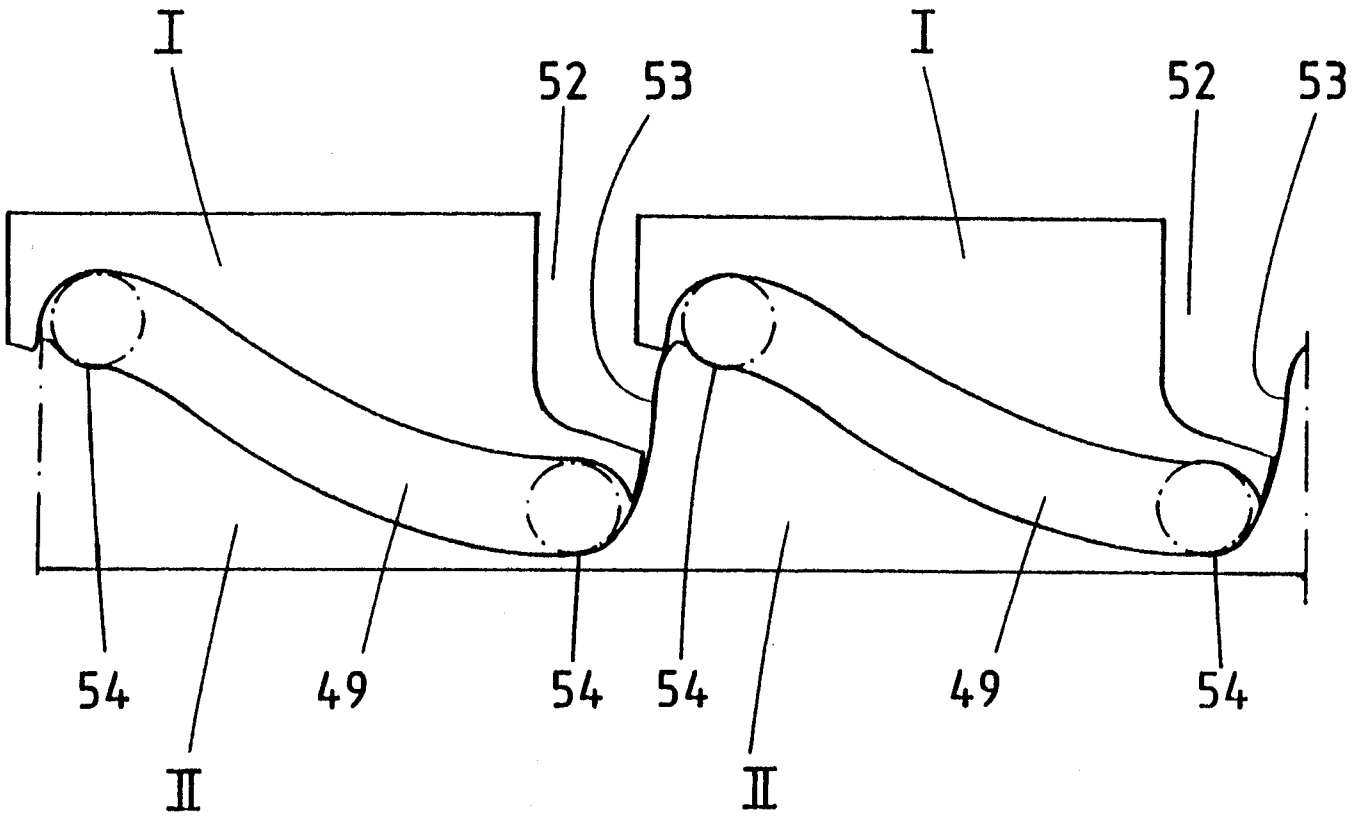
FIG. 7 is a developed view of the slot-guide grooves.

Both guide pins 50, which are arranged diametrically opposite each other each, bear a roller 51 in order to reduce frictional forces. The rollers 51 can be placed on loosely since the inner wall of the handle 3 which extends axially in front thereof acts as a barrier. On the one hand, in order to facilitate assembly and, on the other hand, in order to create grooves which have the largest possible angle in circumferential direction, there are associated with the grooves substantially axially directed introduction shafts 52 which can be closed in assembled condition, as can be noted from the showing of FIG. 7, by a steeply descending back ridge 53.

The course of the two grooves 49 is furthermore selected in such a manner that the more flatly rising section controls the final phase of the pump actuation, i.e. the compression. With increasing compression pressure in the cylinder chamber 9 of the air pump P there is an increasingly easier movement which is easily passed through in the steeper phase however, due to the initial compression. As a result of supporting pockets 54 left in the ends of the grooves 49, there is a certain detent or arresting effect so that any unintentional displacement of the handle 3, for instance, due to accidental contact, etc. in the bag is counteracted.

The dividing of the constriction 47 into the abovedescribed cylinder chamber 9 and the pressure pre-chamber 10 extending in front of it is effected by a transverse wall 55 formed from the start on the housing 1. On the cartridge-side of said transverse wall, there is a pump valve 56. It consists of a free-cut valve flap which is inserted in a mount and covers the centrally located valve opening 57 in the transverse wall 55 from above.

The shoulder Sch adjoining the pressure pre-chamber 10 has supporting ribs 59 formed on its top so that between the surface-stable bottom 13 of the cartridge K and the offset inner housing profile passages 60 remain. The upper edges of the supporting ribs 59, therefore, form the actual ring-shaped cartridge placement bottom in the housing 1.

The piston 46 of the air pump P bears a piston packing 61. It is a cap-shaped body of elastic material such as rubber or the like. To this extent it is also adapted to assume a two-fold function, consisting therein that the piston packing 61 at the same time forms the valve flap 62 of an inlet valve 63 of the pump P, which valve is seated on the piston 46. The piston packing 61 is clipped onto the end of a cap 64 connected by screwing to the air-pump handle 3, said end being also cup shaped and constricted on the housing side. The attachment-side end of the piston 46 forms a corresponding mushroom head behind which an edge bead 61' on the inner edge of the cup-shaped packing engages. The zone forming the actual valve flap 62 and the adjacent horizontal area lie flat on the flat bottom side of the cup bottom or, more accurately stated, the cover 65 of the cup-shaped constriction. In the center of this cover 65, there is also in this case a valve opening 66. In the inserted end position of the piston 46 the flat top of the packing rests in the same plane against the bottom of the transverse wall 55, leaving the light gap which can be noted from FIG. 1.

Another development of the piston packing consists in creating an end-side annular space 67. The latter is of V-shaped cross section but it can also be of trapezoidal cross section. The opening of the V points in the direction of the flat transverse wall 55. The peripheral notch has the purpose of creating the packing-typical piston lip which is undercut but also of creating a pump limiter. When the pressure in the cartridge-receiving space is identical to the pressure in the annular space 67 of the piston 46, further pumping up of the cartridge-receiving space 11 is no longer possible. In the final pressure position, the pump piston closes off the overflow opening towards the cartridge-receiving space 11 and, in this position, leaves a compression-free space.

The operating and function of the dispenser described are as follows: After removal of a protective cap 68 covering the headpiece 2, the spray head push button 41 is exposed for exerting a pressure in the direction of the arrow z.

In order to create or renew and/or supplement the pressure cushion required for dispensing the liquid 5, the housing 1 is grasped with one hand; with the other hand the operator carries out backward and forward turning movements on the handle 3. The slot control leads to a superimposing rotating and axial movement of the piston 46. The pressure produced in this manner is distributed in such a manner proceeding from the pressure pre-chamber 10, that the liquid 5 in the cartridge K is acted on by pressure and compressed air is also in front of the outlet valve 4. If the latter is brought into the open position shown in FIG. 9, both components, air plus liquid, emerge via the branch channel 38 into the outlet channel 39, passing with further mixing through the nozzle 7 and forming the desired jet of stable shape. The compressed air passes in this case through the annular diaphragm 22 which acts as a sluice but which in its turn does not allow any liquid to pass into the remaining head chamber 2' when the dispenser is in a tilted position. For the passing of the pressure the elastic opposite nipple 27 lifts off from the corresponding inner wall of the bushing part 26. The spray jet can be interrupted as soon as the spray device 8 or the spray head push button 41 is released, it returning again into its closed starting position due to the restoring force of the spring 40.

The guide-slot parts around the groove can be produced as individual parts or else at least one of the two parts can be developed at the start on the handle 3. In the embodiment shown, this would be the upper part I. The lower part II is accordingly attached in conventional manner. All parts can be injection molded from plastic; only the compression spring 40 consists of stainless steel.

The container section of the cartridge K can be developed as bag, the cover 15, however, which also has the neck shape described, being developed as a rigid part which is connected to the edge of the bag. The bottom of the bag is also stiffened so that the passages 60 are not clogged.

I claim:

1. A liquid spray device comprising an air pump, a handle, an outlet valve, a headpiece and a housing, the headpiece being removably secured to a first end of the housing, the outlet valve being located at the first end of the housing, the air pump being held by the housing and being operated by the handle, the handle being located at a second end of the housing opposite the first end;

wherein the housing encloses a cartridge receiving chamber for locating a cartridge between the air pump and the outlet valve, a cartridge containing a liquid to be atomized, and the cartridge receiving chamber being configured to provide an air space between a wall of the cartridge receiving chamber and the cartridge for communicating air from the air pump to the outlet valve; and the air pump, upon actuation by the handle, produces a cushion of compressed air within the cartridge receiving chamber and increased pressure within the cartridge for expression of the liquid via the outlet valve and for atomizing the liquid by mixing the liquid with a jet.

2. A liquid spray device according to claim 1, further comprising a plug-connection nipple located on the headpiece and extending into said cartridge-receiving chamber; and said nipple connecting an inside of the cartridge to the compressed air.

3. A liquid spray device according to claim 2, wherein said plug-connection nipple has a liquid barrier.

4. A liquid spray device according to claim 3, further comprising a riser pipe centrally located in said housing for conducting liquid into said headpiece; and wherein said liquid barrier comprises an annular diaphragm, said diaphragm having a lip edge and resting with its lip edge in sealing manner against an outer wall of said riser pipe.

5. A liquid spray device according to claim 1, wherein said housing has a second chamber of cylindrical shape at the second end of the housing, the spray device including an air pump piston which travels in said second chamber; and said handle comprises a rotatable sleeve which is guided on said housing and is connected to said air-pump piston.

6. A liquid spray device according to claim 5, further comprising a guide-slot control at the second end of said housing for operating said handle and said piston as a functional unit.

7. A liquid spray device according to claim 6, wherein said second chamber is formed by a constriction of said housing; and said slot-guide control is located on an outside of said constriction.

8. A liquid spray device according to claim 5, wherein said air-pump piston has a piston packing with an annular space at an end of the packing.

9. A liquid spray device according to claim 8, wherein said air pump piston has a cap and an inlet valve supported by the cap;

said piston packing forms a valve flap of said inlet valve, and is clipped onto a cup-shaped end of said cap; and said cap is connected by threading to said air-pump handle.

10. A liquid spray device according to claim 8, wherein said annular space of said piston packing serves as a pump limiter.

11. A liquid spray device according to claim 1, further comprising a push button and a spring located at a forward end of said spray device, opposite said handle;

wherein said outlet valve is actuated by said spray head push button against a force of said spring in a direction of a normal closed position of said outlet valve.

12. A liquid spray device comprising an air pump, a handle, an outlet valve, a headpiece and a housing, the headpiece being removably secured to a first end of the housing, the outlet valve being located at the first end of the housing, the air pump being held by the housing and being operated by the handle, the handle being located at a second end of the housing opposite the first end;

wherein the housing encloses a cartridge receiving chamber;

the air pump, upon actuation by the handle, produces a cushion of compressed air within the cartridge receiving chamber for expression of the liquid via the outlet valve and for atomizing the liquid by mixing the liquid with a jet;

said housing has a second chamber of cylindrical shape at the second end of the housing, the spray device including an air pump piston which travels in said second chamber;

said handle comprises a rotatable sleeve which is guided on said housing and is connected to said air-pump piston;

a guide-slot control at the second end of said housing for operating said handle and said piston as a functional unit;

said second chamber is formed by a constriction of said housing;

said slot-guide control is located on an outside of said constriction; and a shoulder of said constriction serves as a cartridge-placement bottom of said cartridge-receiving chamber, there being an opening in said bottom.

13. A liquid spray device comprising an air pump, a handle, an outlet valve, a headpiece and a housing, the headpiece being removably secured to a first end of the housing, the outlet valve being located at the first end of the housing, the air pump being held by the housing and being operated by the handle, the handle being located at a second end of the housing opposite the first end;

wherein the housing encloses a cartridge receiving chamber;

the air pump, upon actuation by the handle, produces a cushion of compressed air within the cartridge receiving chamber for expression of the liquid via the outlet valve and for atomizing the liquid by mixing the liquid with a jet;

said housing has a second chamber of cylindrical shape at the second end of the housing, the spray device including an air pump piston which travels in said second chamber;

said handle comprises a rotatable sleeve which is guided on said housing and is connected to said air-pump piston;

a guide-slot control at the second end of said housing for operating said handle and said piston as a functional unit;

said guide-slot control comprises ascending grooves on an inner side of said air-pump handle;

stationary radial guide pins extending outward from said housing; and wherein said guide pins engage into respective ones of said grooves.

14. A liquid spray device according to claim 13, wherein said guide pins have rollers;

said handle has axially directed shaftways in communication with said grooves; and the second end of said housing has ridges for blocking said shaftway communication upon mounting said handle to said housing.

15. A liquid spray device according to claim 13, wherein a course of said ascending grooves is flatter in a final phase of actuation of said pump, said grooves having support pockets for said guide pins in both ends of each of said grooves.

16. A liquid spray device comprising an air pump, a handle, an outlet valve, a headpiece and a housing, the headpiece being removably secured to a first end of the housing, the outlet valve being located at the first end of the housing, the air pump being held by the housing and being operated by the handle, the handle being located at a second end of the housing opposite the first end;

wherein the housing encloses a cartridge receiving chamber;

the air pump, upon actuation by the handle, produces a cushion of compressed air within the cartridge receiving chamber for expression of the liquid via the outlet valve and for atomizing the liquid by mixing the liquid with a jet;

said housing has a second chamber of cylindrical shape at the second end of the housing, the spray device including an air pump piston which travels in said second chamber;

said handle comprises a rotatable sleeve which is guided on said housing and is connected to said air-pump piston;

a guide-slot control at the second end of said housing for operating said handle and said piston as a functional unit;

said second chamber is formed by a constriction of said housing;

said slot-guide control is located on an outside of said constriction;

a pump valve encircled by the constriction of said housing; and wherein said second chamber has a transverse wall which bears the pump valve on a side of said transverse wall facing said cartridge-receiving chamber, said transverse wall separating said second chamber from said cartridge-receiving chamber and defining a pressure pre-chamber between said transverse wall and said cartridge-receiving chamber.

17. A liquid spray device comprising an air pump, a handle, an outlet valve, a headpiece and a housing, the headpiece being removably secured to a first end of the housing, the outlet valve being located at the first end of the housing, the air pump being held by the housing and being operated by the handle, the handle being located at a second end of the housing opposite the first end;

wherein the housing encloses a cartridge receiving chamber; and the air pump, upon actuation by the handle, produces a cushion of compressed air within the cartridge receiving chamber for expression of the liquid via the outlet valve and for atomizing the liquid by mixing the liquid with a jet;

a plug-connection nipple located on the headpiece and extending into said cartridge-receiving chamber;

a cartridge in said chamber, said nipple connecting an inside of the cartridge to the compressed air;

a perforated holding plate at the first end of said housing;

wherein said plug-connection nipple is formed centrally on said perforated holding plate and extends toward the second end of said housing;

said holding plate is edge-mounted to the housing at an interface with said headpiece;

said holding plate is screwed to said housing; and said spray device further comprises a second nipple extending from said holding plate toward said headpiece to be plugged into the headpiece.

18. A liquid spray device according to claim 17, wherein said headpiece defines a further chamber, and said second nipple forms a channel of rotational symmetry, the channel branching into a first branch and a second branch wherein the first branch leads to the outlet valve while the second branch leads to the further chamber via an opening in said holding plate.

* * * * *